US010100838B2

(12) United States Patent
Kinoshita et al.

(10) Patent No.: US 10,100,838 B2
(45) Date of Patent: Oct. 16, 2018

(54) ELECTRIC COMPRESSOR INCLUDING A RIB STRUCTURE FOR SECURING AN ELECTRIC COMPONENT

(71) Applicant: KABUSHIKI KAISHA TOYOTA JIDOSHOKKI, Kariya-shi, Aichi-ken (JP)

(72) Inventors: Yusuke Kinoshita, Kariya (JP); Ken Suitou, Kariya (JP); Tatsuya Koide, Kariya (JP); Akio Fujii, Kariya (JP)

(73) Assignee: KABUSHIKI KAISHA TOYOTA JIDOSHOKKI, Kariya-shi, Aichi-ken (JP)

( * ) Notice: Subject to any disclaimer, the term of this patent is extended or adjusted under 35 U.S.C. 154(b) by 272 days.

(21) Appl. No.: 14/813,821

(22) Filed: Jul. 30, 2015

(65) Prior Publication Data

US 2016/0032930 A1 Feb. 4, 2016

(30) Foreign Application Priority Data

Aug. 4, 2014 (JP) ..... 2014-158820

(51) Int. Cl.
*F04D 25/06* (2006.01)
*F04B 53/22* (2006.01)
(Continued)

(52) U.S. Cl.
CPC ..... *F04D 25/0693* (2013.01); *F04B 53/16* (2013.01); *F04B 53/22* (2013.01);
(Continued)

(58) Field of Classification Search
CPC ..... F04C 2240/30; F04C 2240/803; F04C 2240/808; F04C 23/02; F04D 25/0693;
(Continued)

(56) References Cited

U.S. PATENT DOCUMENTS

2010/0018243 A1* 1/2010 Tanaka ..... F04B 39/121 62/508
2010/0172770 A1* 7/2010 Ichise ..... F04B 35/04 417/366
(Continued)

FOREIGN PATENT DOCUMENTS

JP 2005-344689 A 12/2005
JP 2008-163766 A 7/2008
(Continued)

OTHER PUBLICATIONS

Communication dated Jan. 19, 2017 issued by the Intellectual Property Office in Korea in counterpart KR application No. 10-2015-0108116.
Communication dated Sep. 20, 2016, from the Japanese Patent Office in counterpart Japanese application No. 2014-158820.

*Primary Examiner* — Essama Omgba
*Assistant Examiner* — Stephen Mick
(74) *Attorney, Agent, or Firm* — Sughrue Mion, PLLC

(57) ABSTRACT

An electric compressor is provided to more securely suppress breakage of an electric component. An inverter cover forms an accommodation space. A bus bar constituting a portion of an electric circuit for driving an electric motor is accommodated in the accommodation space. The inverter cover has a rib projecting into the accommodation space. The bus bar is placed on the rib.

4 Claims, 4 Drawing Sheets

(51) Int. Cl.
*F04B 53/16* (2006.01)
*F04C 23/02* (2006.01)

(52) U.S. Cl.
CPC ..... *F04C 23/02* (2013.01); *F04C 2240/30* (2013.01); *F04C 2240/803* (2013.01); *F04C 2240/808* (2013.01)

(58) Field of Classification Search
CPC .. F04D 13/06; F04D 13/0686; F04D 13/0693; Y10T 29/49947; F04B 17/03; F04B 35/04; F04B 39/12; F04B 39/121; F04B 53/16; F04B 53/22; F04B 39/14; F04B 25/068; F04B 29/40; F04B 29/403; F04B 29/406; F04B 29/60
USPC ..... 417/410.1; 29/525.01
See application file for complete search history.

(56) References Cited

U.S. PATENT DOCUMENTS

| | | | | |
|---|---|---|---|---|
| 2010/0181850 | A1 | 7/2010 | Ichise et al. | |
| 2013/0119834 | A1* | 5/2013 | Nakagami ..... | F04B 39/121 310/68 D |

FOREIGN PATENT DOCUMENTS

| | | | |
|---|---|---|---|
| JP | 2009-106074 | A | 5/2009 |
| JP | 2009-114961 | A | 5/2009 |
| JP | 2009-130963 | A | 6/2009 |
| JP | 2013-177826 | A | 9/2013 |
| KR | 10-0153809 | B1 | 12/1998 |

* cited by examiner

ELECTRIC COMPRESSOR INCLUDING A RIB STRUCTURE FOR SECURING AN ELECTRIC COMPONENT

This nonprovisional application is based on Japanese Patent Application No. 2014-158820 filed on Aug. 4, 2014 with the Japan Patent Office, the entire contents of which are hereby incorporated by reference.

BACKGROUND OF THE INVENTION

Field of the Invention

The present invention relates to an electric compressor, in particular, an electric compressor having an accommodation space formed therein to accommodate an electric component.

Description of the Background Art

In recent years, as a compressor provided in a vehicle such as a hybrid vehicle, an electric vehicle, a fuel cell vehicle or the like, there has been developed an electric compressor in which a compressing unit, an electric motor, and a driving circuit for driving the electric motor are incorporated for size reduction.

Japanese Patent Laying-Open No. 2009-114961 discloses an electric compressor for a vehicular air conditioning device, wherein an inverter accommodation portion is provided at the outer circumference of a housing including an electric motor and a compressor mechanism, and an inverter device for supplying electric power to the electric motor is accommodated and installed in the inverter accommodation portion. Japanese Patent Laying-Open No. 2009-114961 discloses a technique of suppressing vibration and deformation of a bus bar assembly, which connects between a control board and an electric component installed in the inverter accommodation portion, by fastening and fixing the bus bar assembly to the inverter accommodation portion with screws.

SUMMARY OF THE INVENTION

In the configuration disclosed in Japanese Patent Laying-Open No. 2009-114961, the bus bar assembly is fixed to the inverter accommodation portion at spots by means of screws. Accordingly, when vibration occurs due to driving of the inverter device, resonance of the bus bar assembly cannot sufficiently be suppressed, which still presumably results in breakage of the resin-molded bus bar assembly.

The present invention is made in view of the above-mentioned problem, and has a main object to provide an electric compressor capable of more securely suppressing breakage of an electric component.

An electric compressor according to the present invention includes: a compressing unit that compresses fluid; an electric motor that drives the compressing unit; a housing that accommodates the compressing unit and the electric motor; an electric component; and a cover. The electric component constitutes a portion of an electric circuit for driving the electric motor. The cover forms an accommodation space together with the housing to accommodate the electric component. At least one of the housing and the cover has a rib projecting into the accommodation space. The electric component is placed on the rib.

Preferably in the electric compressor, the electric component has a rectangle portion having a rectangular shape. The rib has an extension portion extending in a long-length direction of the rectangle portion. The rectangle portion is placed on the extension portion.

Preferably in the electric compressor, the rib has a plurality of fastening portions fastened to the electric component. The extension portion is disposed between the plurality of fastening portions.

Preferably in the electric compressor, the electric component has a lead terminal for external connection. The rib has a lead supporting portion. The lead terminal is placed on the lead supporting portion.

Preferably in the electric compressor, the rib has a positioning portion projecting from a surface of the rib on which the electric component is placed. The positioning portion is in abutment with an outer circumference of the electric component.

Preferably in the electric compressor, the rib has a fastening portion fastened to the electric component by a screw, and a positioning portion projecting from a surface of the rib on which the electric component is placed. The positioning portion is disposed at a forward location relative to the electric component in a turning direction of the screw when fastening the electric component and the fastening portion to each other by the screw.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
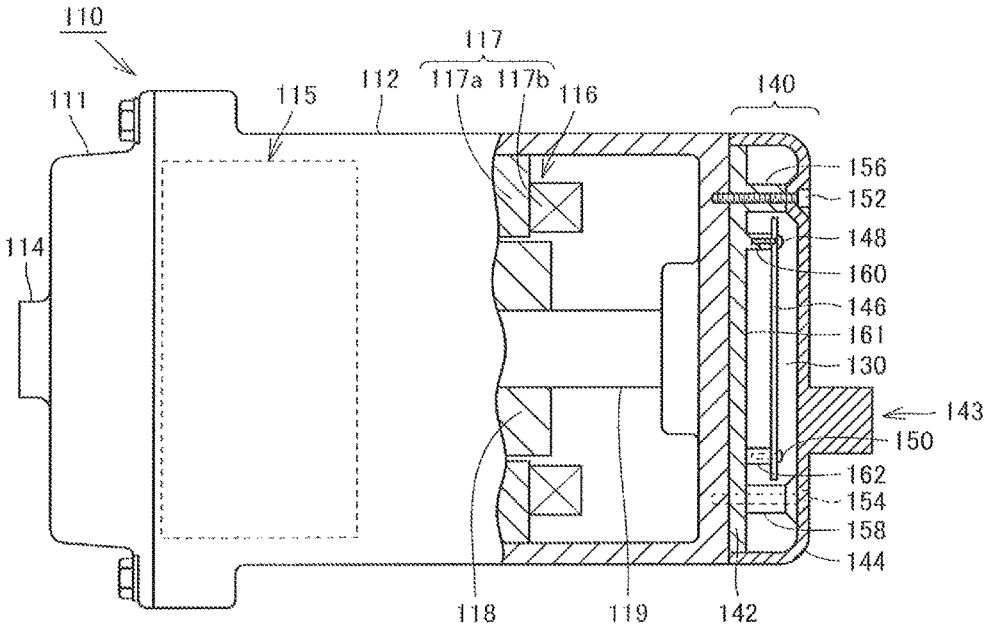
FIG. 1 is a schematic diagram showing an entire configuration of an electric compressor according to the present embodiment.

The following describes an embodiment of the present invention in detail with reference to figures. It should be noted that the same or corresponding portions are given the same reference characters and are not described repeatedly.

FIG. 1 is a schematic diagram showing an entire configuration of an electric compressor 110 according to the present embodiment. As shown in FIG. 1, the electric compressor 110 includes: a compressing unit 115 for compressing refrigerant; an electric motor 116 for driving the compressing unit 115; and an inverter unit 140. The compressing unit 115 and the electric motor 116 are accommodated in a suction housing 112. Although not shown in the figure, for example, the compressing unit 115 is configured to include a fixed scroll fixed in the suction housing 112 and a movable scroll disposed to face the fixed scroll.

The suction housing 112, which has a shape of cylinder with a bottom and is made of aluminum (metal material), is joined to a discharge housing 111, which has a cover-like shape and is made of aluminum (metal material), thereby forming a housing.

The inverter unit 140 is attached to be integrated with the suction housing 112. An outline of the electric compressor 110 is formed by the housing and an inverter cover 144 of the inverter unit 140.

A suction port not shown in the figure is formed at the bottom portion side of the circumferential wall of the suction housing 112. An external refrigerant circuit not shown in the figure is connected to the suction port. A discharge port 114 is formed at the discharge housing 111. The discharge port 114 is connected to the external refrigerant circuit.

The suction housing 112 has an inner circumferential surface to which a stator 117 is fixed. The stator 117 is configured to include: a stator core 117*a* fixed to the inner circumferential surface of the suction housing 112; and coils 117*b* wound around teeth (not shown) of the stator core 117*a*.

In the suction housing 112, a rotating shaft 119, which is inserted in the stator 117, is rotatably supported. A rotor 118 is fixed to the rotating shaft 119.

The inverter unit 140 is provided on the suction housing 112 at an external surface of the suction housing 112 opposite to an external surface thereof provided with the discharge housing 111. The inverter unit 140 includes an aluminum base 142, a circuit board 146, and the inverter cover 144.

The inverter cover 144 covers the circuit board 146 to protect it from contamination, humidity, and the like. The inverter cover 144 is formed of a resin for weight reduction. In order to reduce influence of noise over the inverter circuit and suppress emission of generated electromagnetic noise from the circuit board 146 to outside, a metal plate is provided in the resin of the inverter cover 144.

The aluminum base 142 includes a bottom plate 161 and legs 156, 158, 160, 162 provided in the bottom plate 161. The inverter cover 144 is fixed to the suction housing 112 by screws 152, 154 at both sides with bottom plate 161 of the aluminum base 142 and legs 156, 158 interposed therebetween. The legs 156, 158 are formed in the bottom plate 161. In the inverter cover 144, a power supply input port 143 having a cylindrical shape is formed to be supplied with a DC power supply voltage from outside.

Between the housing and the inverter cover 144, a hollow accommodation space 130 is formed to accommodate the circuit board 146 and a bus bar 30 described later. The inverter cover 144 forms the accommodation space 130 together with the housing to accommodate the bus bar 30 and the circuit board 146. The accommodation space 130 is formed as a sealed space by the inverter cover 144 and the housing.

The circuit board 146 is accommodated in the accommodation space 130 between the inverter cover 144 and the housing such that the mounting surface of the circuit board 146 is orthogonal to the axial direction of the rotating shaft 119. In the present embodiment, the compressing unit 115, the electric motor 116, and the inverter unit 140 are arranged side by side in this order in the axial direction of the rotating shaft 119.

The aluminum base 142 is fastened to the suction housing 112 by screws 152, 154. The aluminum base 142 and the suction housing 112 are each made of metal having good heat conductivity and are in close contact with each other. Hence, the aluminum base 142 serves to dissipate heat from the inverter unit 140 by conducting the heat in the inverter unit 140 to the suction housing 112.

Figure 2:
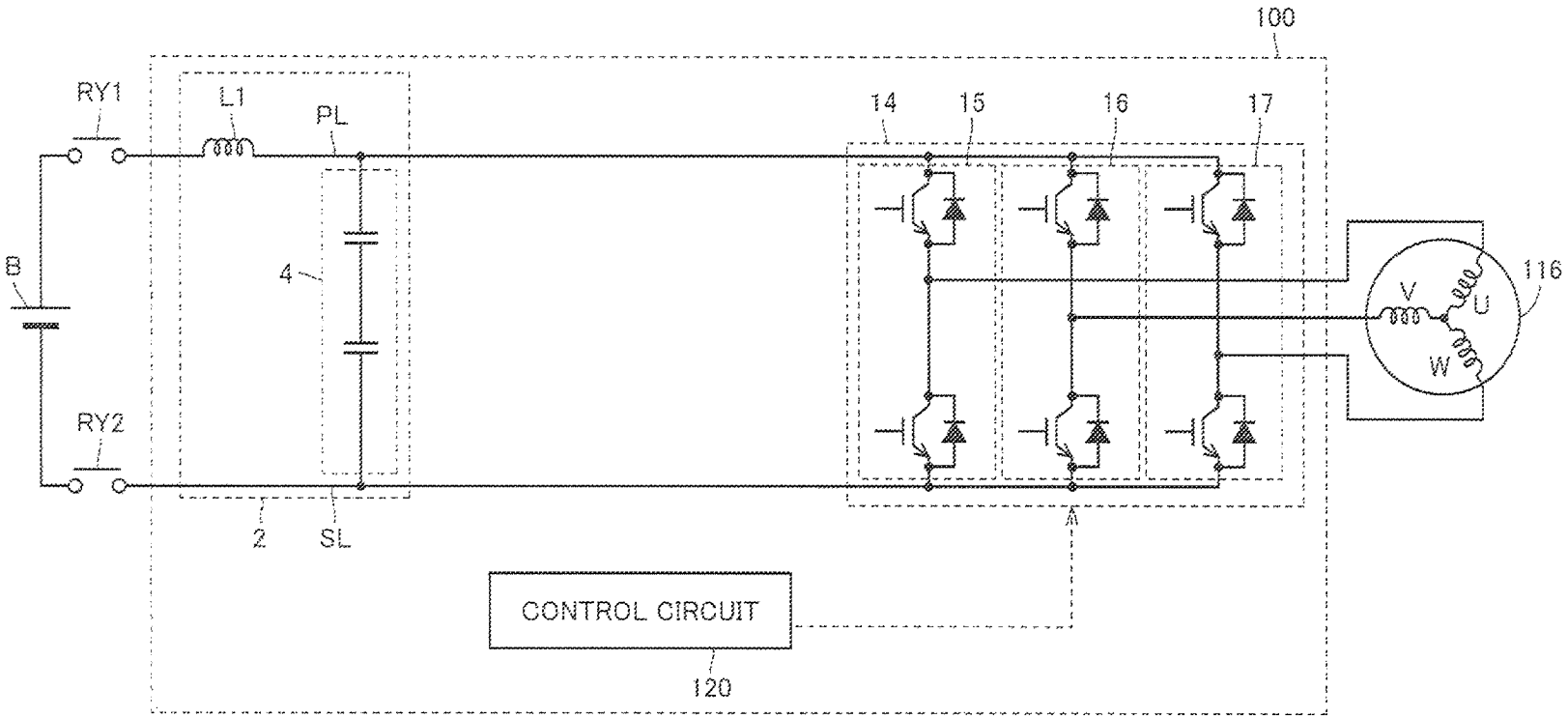
FIG. 2 is a circuit diagram of a driving circuit that drives an electric motor.

The circuit board 146 is fixed by screws 148, 150 to the legs 160, 162 formed in the bottom plate 161 of the aluminum base 142, with a space between the circuit board 146 and the bottom plate 161. In the space therebetween, a driving control circuit (inverter circuit) for the electric motor 116 as well as an electromagnetic coil L1 and a capacitor circuit 4, which form a below-described filter circuit shown in FIG. 2, are accommodated. The driving control circuit is mounted on the circuit board 146.

Electric power controlled by the inverter unit 140 is supplied to the electric motor 116, thereby rotating the rotor 118 and the rotating shaft 119 at a controlled rotational speed. By this rotation, the compressing unit 115 is driven. By driving the compressing unit 115, the refrigerant is suctioned from the external refrigerant circuit into the suction housing 112 via the suction port, the refrigerant thus suctioned into the suction housing 112 is compressed by the compressing unit 115, and the compressed refrigerant is discharged to the external refrigerant circuit via the discharge port 114.

FIG. 2 is a circuit diagram of a driving circuit 100 that drives electric motor 116. With reference to FIG. 2, the driving circuit 100 includes the electromagnet coil L1 and the capacitor circuit 4, the inverter circuit 14, and a control circuit 120.

The electromagnetic coil L1 is connected between the positive electrode of a DC power supply B and a positive electrode bus PL. The capacitor circuit 4 is connected between the positive electrode bus PL and a negative electrode bus SL. The electromagnetic coil L1 and the capacitor circuit 4 constitute the low-pass filter circuit 2.

The inverter circuit 14 includes an U phase arm 15, a V phase arm 16, and a W phase arm 17. Each of the U phase arm 15, the V phase arm 16, and the W phase arm 17 is connected between the positive electrode bus PL and the negative electrode bus SL. The U phase arm 15 is connected to one end of an U phase coil of the stator of the electric motor 116. The V phase arm 16 is connected to one end of a V phase coil of the stator of the electric motor 116. The W phase arm 17 is connected to one end of a W phase coil of the stator of the electric motor 116. The other end of each of the U phase coil, the V phase coil, and the W phase coil of the stator of the electric motor 116 is connected to a neutral point.

By controlling switching of transistors included in the U phase arm 15, the V phase arm 16, and the W phase arm 17, a three-phase alternating current is output from the inverter circuit 14 to the stator coils of the electric motor 116.

The inverter circuit 14 is supplied with a DC voltage from the DC power supply B via relays RY1, RY2 and the low-pass filter circuit 2.

The control circuit 120 is configured to include a CPU (Central Processing Unit) and the like and executes a computer program that controls driving of the electric motor 116.

Figure 3:
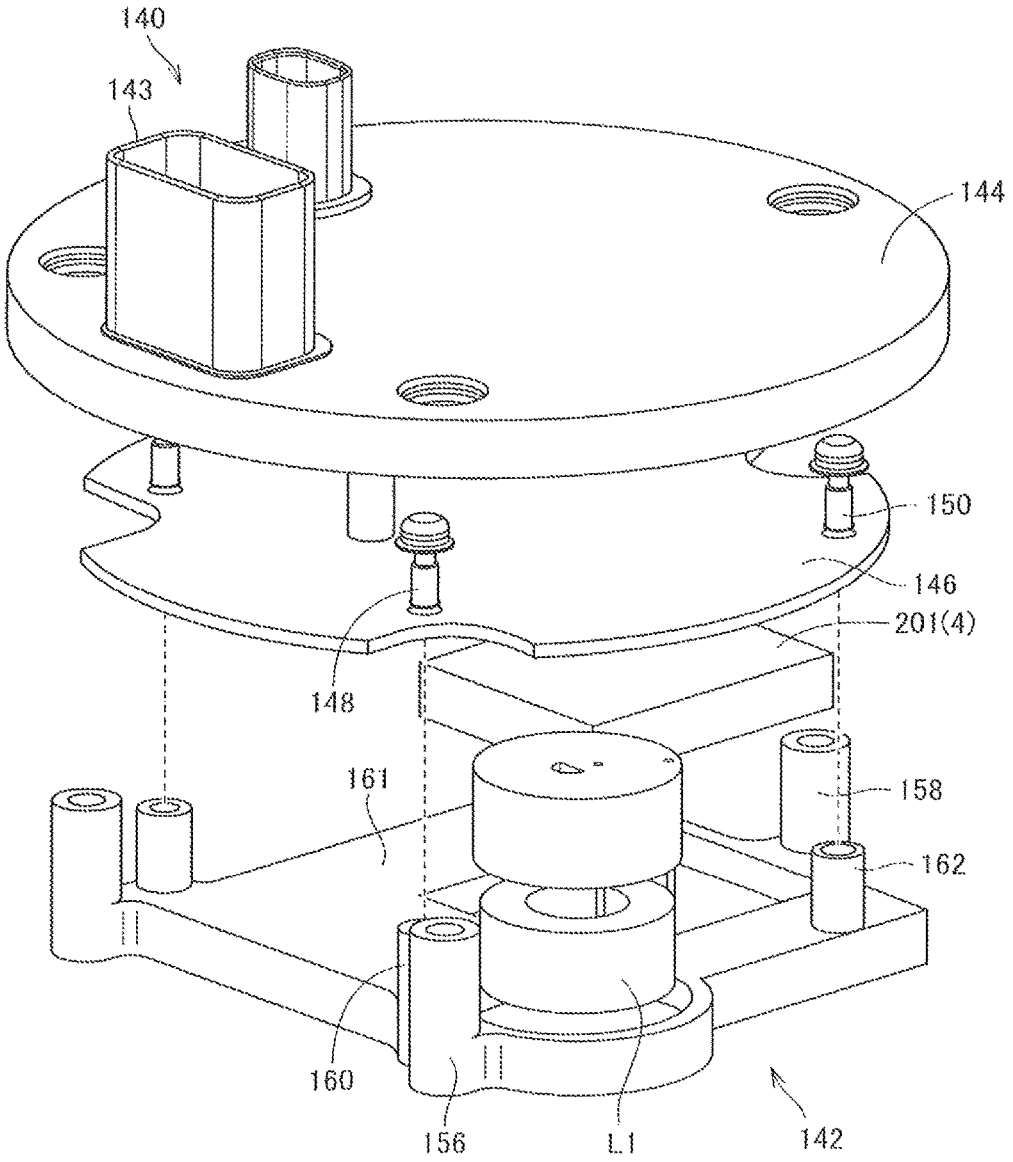
FIG. 3 shows a lamination structure within an inverter unit.

FIG. 3 shows a lamination structure within the inverter unit 140. Onto the circuit board 146 shown in FIG. 3, each of leads of the electromagnetic coil L1 and the capacitor circuit 4 constituting the low-pass filter circuit 2 shown in FIG. 2 is soldered and mounted. The inverter cover 144 is for accommodation of the driving circuit 100 shown in FIG. 2.

In the bottom plate 161 of the aluminum base 142, a depression is formed in conformity with the shape of the electromagnetic coil L1 and a depression is formed in conformity with the shape of the capacitor cover 201 for the accommodating capacitor circuit 4. By providing the depressions in the aluminum base 142, the electromagnetic coil L1 and the capacitor circuit 4 are in close contact with the aluminum base 142. This facilitates dissipation of heat generated in the low-pass filter circuit 2 from the aluminum base 142 to the housing.

Figure 4:
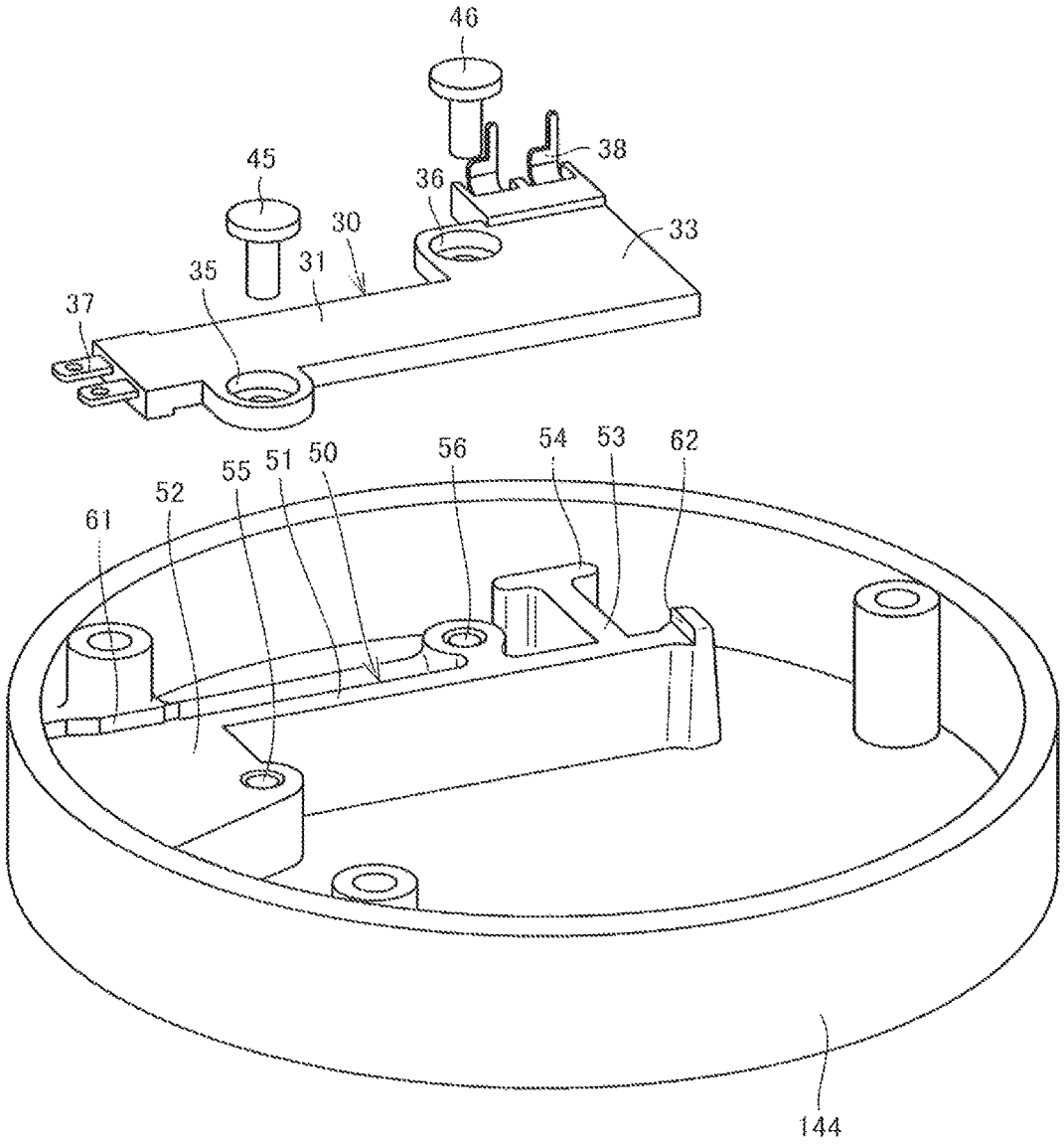
FIG. 4 is an exploded perspective view of an inverter cover shown in FIG. 3 and a bus bar when viewing the inverter cover from the rear side.

FIG. 4 is an exploded perspective view of the inverter cover 144 and the bus bar 30 when viewing the inverter cover 144 shown in FIG. 3 from the rear side. The bus bar 30 shown in FIG. 4 is an electric component for supplying the voltage of the DC power source B to the inverter circuit 14. The bus bar 30 is formed through resin molding of a conductor that connects between the DC power source B and the circuit board 146. The bus bar 30 constitutes a portion of the electric circuit for driving the electric motor 116.

In the present embodiment, the bus bar 30 includes: a long-length portion 31 serving as a rectangle portion having a rectangular shape; and a short-length portion 33 extending from one end side of the long-length portion 31 in the short-length direction of the long-length portion 31. The bus bar 30 has a substantially L-like shape obtained by combining the long-length portion 31 and the short-length portion 33 with each other.

A connector 37 is provided at the other end portion of the long-length portion 31 opposite to its side to which the short-length portion 33 is connected. By providing a conducting wire to extend via the power supply input port 143 shown in FIGS. 1 and 3 and connecting the conducting wire to the connector 37, the external DC power source B and the bus bar 30 are connected to each other.

A lead terminal 38 for external connection is provided at an end portion of the short-length portion 33 opposite to its side connected to the long-length portion 31. The lead terminal 38 is connected to the conductor on the surface of the circuit board 146 having the driving circuit 100 thereon. Accordingly, the DC power source B and the driving circuit 100 are connected via the bus bar 30. The bus bar 30 is connected to the driving circuit 100 for driving the electric motor 116.

The bus bar 30 is provided with two through holes 35, 36 extending through the bus bar 30 in the thickness direction. Each of the through holes 35, 36 is formed to have a shape with a cylindrical inner circumferential surface. The through hole 36 is provided within a corner portion formed by the long-length portion 31 and the short-length portion 33. That is, the through hole 36 is provided at the one end side of the long-length portion 31 in the short-length direction. The through hole 35 is provided at the other end side of the long-length portion 31 in the short-length direction. The long-length portion 31 is disposed between the two through holes 35, 36.

The inverter cover 144 has a rib 50. The rib 50 is provided to project from the surface of the inverter cover 144 facing the aluminum base 142 (the surface facing the aluminum base 142 shown in FIGS. 1 and 3). That is, the rib 50 projects into the accommodation space 130 formed between the housing and the inverter cover 144, which have been described with reference to FIG. 1.

The rib 50 has an extension portion 51 extending in the form of a straight line. Moreover, the rib 50 has connection portions 52, 53 connected to the extension portion 51. The connection portions 52, 53 extend in parallel. The connection portions 52, 53 extend in a direction that crosses the direction in which the extension portion 51 extends. The connection portion 52 is connected to one end portion of the extension portion 51. The connection portion 53 is connected to the extension portion 51 in the vicinity of the other end portion of the extension portion 51. The extension portion 51 connects the connection portion 52 and the connection portion 53 to each other. The connection portion 53 is provided at a side opposite to the connection portion 52 relative to the extension portion 51. The extension portion 51 is disposed between the connection portions 52, 53.

The connection portion 52 has a tip provided with a fastening portion 55 for fastening and fixing the bus bar 30 to the rib 50. A fastening portion 56, which is a second fastening portion different from the fastening portion 55, is provided at a side opposite to the fastening portion 55 relative to the extension portion 51. The extension portion 51 connects the fastening portion 55 and the fastening portion 56 to each other. In the direction in which the extension portion 51 extends, the fastening portion 56 is disposed between the two connection portions 52, 53. The extension portion 51 is disposed between the two fastening portions 55, 56. Each of the fastening portions 55, 56 is provided with a hole having a bottom, and the hole has an inner circumferential surface provided with an internal thread. The internal thread hole is formed in each of the fastening portions 55, 56.

The bus bar 30 is placed on the rib 50, a screw 45 is screwed into the internal thread hole of the fastening portion 55 via the through hole 35, and a screw 46 is screwed into the internal thread hole of the fastening portion 56 via the through hole 36, whereby the bus bar 30 is mounted on the rib 50. The bus bar 30 is attached onto the rib 50 by fastening it with the screws, and is accordingly fixed to the inverter cover 144. When the bus bar 30 is mounted on the rib 50, the extension portion 51 of the rib 50 extends in the long-length direction of the long-length portion 31 of the bus bar 30. The long-length portion 31 of the bus bar 30 is placed on the extension portion 51, and is supported by the extension portion 51 in the long-length direction.

The connection portion 53 has a tip provided with a lead supporting portion 54. The lead supporting portion 54 extends in a direction that crosses the direction in which the connection portion 53 extends, typically, a direction orthogonal to the direction in which the connection portion 53 extends. The lead supporting portion 54 extends in parallel with the direction in which the extension portion 51 extends. When the bus bar 30 is mounted on the rib 50, the lead terminal 38 of the bus bar 30 is placed on the lead supporting portion 54. The lead supporting portion 54 supports the lead terminal 38 from below.

The rib 50 has two positioning portions 61, 62. The extension portion 51 of the rib 50 projects from the inverter cover 144, and the positioning portions 61, 62 project from the top surface of the extension portion 51 (the surface of the extension portion 51 in abutment with the bus bar 30). The positioning portions 61, 62 project from the surface of the rib 50 on which the bus bar 30 is placed. The positioning portions 61, 62 are provided to position the bus bar 30 placed on the rib 50. When the bus bar 30 is placed on the rib 50, each of the positioning portions 61, 62 faces a portion of the side surface of the bus bar 30 (the surface of the bus bar 30 extending in the thickness direction). The positioning portions 61, 62 are in abutment with the outer circumference of the bus bar 30.

The internal thread holes formed in the fastening portions 55, 56 are right-hand threads, with which the screws 45, 46 are tighten when turned clockwise. Hence, when fixing the bus bar 30, the screws 45, 46 are turned in the clockwise direction. The positioning portion 61 is disposed at a forward location in the turning direction of the screw 46 relative to the bus bar 30 when fastening the bus bar 30 and the fastening portion 56 to each other by the screw 46. The positioning portion 62 is disposed at a forward location in the turning direction of the screw 45 relative to the bus bar 30 when fastening the bus bar 30 and the fastening portion 55 to each other by the screw 45.

Next, the following describes function and effect of the present embodiment.

As shown in FIG. 4, the electric compressor 110 of the present embodiment includes the inverter cover 144. The inverter cover 144 has the rib 50. The rib 50 projects into the accommodation space 130 from the surface of the inverter cover 144 facing the suction housing 112. The rib 50 has the extension portion 51 extending in the long-length direction of the long-length portion 31 of the bus bar 30. The bus bar 30 is placed on the rib 50.

With the structure in which the rib 50 is provided to extend in the same direction as the direction in which the long-length portion 31 of the bus bar 30 extends and the bus bar 30 is supported by the rib 50 in the long-length direction of the long-length portion 31, the supporting structure for the bus bar 30 can be improved in terms of strength. Moreover, since the bus bar 30 is fixed to the inverter cover 144, the bus bar 30 can be suppressed from vibrating in a natural mode when the inverter cover 144 vibrates. Because the bus bar 30 having the rectangle portion with the rectangular shape is weak with respect to force from both the ends of the rectangle portion in the long-length direction, the structure providing support by the rib 50 in the long-length direction of the rectangle portion can more securely suppress breakage of the bus bar 30.

Moreover, by forming the rib 50 in the inverter cover 144, the inverter cover 144 can be improved in terms of rigidity, thereby suppressing the inverter cover 144 from resonating like a drum and accordingly suppressing increase of vibration.

Moreover, as shown in FIG. 4, the bus bar 30 has the lead terminal 38 for external connection. The rib 50 has the lead supporting portion 54. When the bus bar 30 is placed on the rib 50, the lead terminal 38 is placed on the lead supporting portion 54. In this way, the lead terminal 38 can be supported by the lead supporting portion 54 of the rib 50 to improve strength of the supporting structure of the lead terminal 38, thereby suppressing breakage of the bus bar 30 at the location of the lead terminal 38.

Moreover, as shown in FIG. 4, the rib 50 has the plurality of fastening portions 55, 56 to fix the bus bar 30. The extension portion 51 is disposed between the plurality of fastening portions 55, 56. By fixing the bus bar 30 to the rib 50 at the plurality of locations that sandwich the extension portion 51, the bus bar 30 can be securely fixed to the rib 50, thereby suppressing breakage of the bus bar 30 more securely.

Moreover, as shown in FIG. 4, the rib 50 has the positioning portions 61, 62 projecting from the surface of the rib on which the bus bar 30 is placed. The positioning portions 61, 62 are in abutment with the outer circumference of the bus bar 30. By positioning the bus bar 30 using the positioning portions 61, 62, relative positioning between the bus bar 30 and the circuit board 146 can be facilitated, thereby readily automatically attaining connection therebetween. By utilizing rib 50 itself for the positioning of the bus bar 30, positioning accuracy of the bus bar 30 can be improved with such a simple configuration.

Moreover, as shown in FIG. 4, the positioning portions 61, 62 are disposed at the forward locations in the turning direction of the screws 45, 46 relative to the bus bar 30 when fastening the bus bar 30 and the fastening portions 55, 56 to each other by the screws 45, 46. Accordingly, even if torque is exerted on the bus bar 30 when fastening the bus bar 30 to the inverter cover 144 using the screws, the positioning portions 61, 62 disposed at the downstream of the turning direction of the screws prevent turning of the bus bar 30, thereby preventing the bus bar 30 from being turned together with the screws. Therefore, the bus bar 30 can be more securely positioned in the accommodation space 30.

It should be noted that in the description of the embodiment above, it has been illustrated that the electric component placed on the rib 50 is the bus bar 30. The electric component placed on the rib 50 is not limited to the bus bar 30, and may be an electric component constituting a portion of the electric circuit for driving the electric motor 116. For example, the electric component may be an electric component that constitutes the driving circuit 100 shown in FIG. 2, such as the electromagnet coil L1 or a capacitor included in the capacitor circuit 4.

Moreover, it has been illustrated that the inverter cover 144 has the rib 50 but the present invention is not limited to this configuration, and the rib projecting into the accommodation space 130 may be formed in the housing that forms the accommodation space 130 together with the inverter cover 144, and the electric component may be placed on the rib.

Although the present invention has been described and illustrated in detail, it is clearly understood that the same is by way of illustration and example only and is not to be taken by way of limitation, the scope of the present invention being interpreted by the terms of the appended claims.

What is claimed is:

1. An electric compressor comprising:

a compressing unit that compresses fluid;

an electric motor that drives the compressing unit;

a housing that accommodates the compressing unit and the electric motor;

an electric component that constitutes a portion of an electric circuit for driving the electric motor; and a cover that forms an accommodation space together with the housing to accommodate the electric component, at least one of the housing and the cover having a rib projecting into the accommodation space, the electric component being disposed on the rib, wherein:

the electric component has a rectangle portion having a rectangular shape and a short-length portion extending away from one end of the rectangular portion in a short-length direction of the rectangular portion, the rib has an extension portion extending in a long-length direction of the rectangle portion, and the rib has a connection portion, wherein the connection portion is connected to the extension portion and extends in a direction that crosses the long-length direction of the rectangle portion, the rectangle portion of the electric component is disposed on the extension portion of the rib, and the short-length portion of the electric component is disposed on the connection portion of the rib, a width of the extension portion widens at an end so that the end supports the rectangle portion of the electric component, and a width of the connection portion widens at a tip end so that the tip end supports the short-length portion of the electric component;

the rib has a plurality of fastening portions fastened to the electric component, the extension portion is disposed between the plurality of fastening portions, the electric component is provided with a plurality of through holes for being fastened to the fastening portions of the rib; and at least one of the plurality of through holes is provided within a corner portion formed by the rectangle portion and the short-length portion.

2. The electric compressor according to claim 1, wherein the electric component has a lead terminal for external connection, and the rib has a lead supporting portion, and the lead terminal is placed on the lead supporting portion.

3. The electric compressor according to claim 1, wherein the rib has a positioning portion projecting from a surface of the rib on which the electric component is disposed, and the positioning portion is in abutment with an outer circumference of the electric component.

4. The electric compressor according to claim 1, wherein the rib has a positioning portion projecting from a surface of the rib on which the electric component is disposed, and the positioning portion is disposed at a forward location relative to the electric component in a turning direction of the screw when fastening the electric component and the fastening portion to each other by the screw.

* * * * *